US006429602B1

(12) United States Patent
Takahashi et al.

(10) Patent No.: US 6,429,602 B1
(45) Date of Patent: Aug. 6, 2002

(54) FLUORESCENT LAMP OPERATING APPARATUS

(75) Inventors: Kenichiro Takahashi; Kazuhiko Ito; Takayuki Imai, all of Osaka; Mamoru Takeda, Kyoto, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/704,735

(22) Filed: Nov. 3, 2000

(30) Foreign Application Priority Data

Nov. 5, 1999 (JP) ..... 11-315162

(51) Int. Cl.[7] ..... H05B 37/02

(52) U.S. Cl. ..... 315/209 R; 315/224; 315/200 R; 315/DIG. 7; 315/291

(58) Field of Search ..... 315/209 R, 224, 315/225, 291, 297, 307, DIG. 7, DIG. 5, 200 R

(56) References Cited

U.S. PATENT DOCUMENTS 4,935,822 A * 6/1990 Herbsled et al. ..... 363/132
5,426,350 A * 6/1995 Lai ..... 315/224
5,543,690 A * 8/1996 Bernicke et al. ..... 315/224
5,796,214 A 8/1998 Nerone
5,825,136 A * 10/1998 Rudolph ..... 315/291
6,118,227 A * 9/2000 Beland ..... 315/276

FOREIGN PATENT DOCUMENTS

| | | |
|---|---|---|
| JP | 10-162983 | 6/1998 |
| JP | 2000-036393 | 2/2000 |
| JP | 2000-182796 | 6/2000 |
| JP | 2000-268985 | 9/2000 |
| TW | 342573 | 10/1998 |

OTHER PUBLICATIONS

Notice of Reasons of Rejection, Mailing Date: Feb. 5, 2002, Mailing No. 032935, Patent Application No. 2000–329894 with English Translation.

* cited by examiner

*Primary Examiner*—Don Wong
*Assistant Examiner*—Tuyet T. Vo
(74) *Attorney, Agent, or Firm*—Nixon Peabody LLP; Donald R. Studebaker

(57) ABSTRACT

A fluorescent lamp operating apparatus comprises a power switching element electrically connected to a fluorescent lamp having a pair of electrodes, and means for limiting the current flowing through the power switching element by controlling its conductance so as to prevent the power switching element from being broken by a large current flowing from the power line through the fluorescent lamp when the impedance between the pair electrodes decreases from infinity at the start-up of the fluorescent lamp.

5 Claims, 9 Drawing Sheets

FLUORESCENT LAMP OPERATING APPARATUS

BACKGROUND OF THE INVENTION

The present invention relates to a fluorescent lamp operating apparatus containing an inverter circuit.

As a conventional fluorescent lamp operating apparatus, such a series inverter as disclosed in Japanese Laid-Open Patent Application No. 10-162983 is known. The applicant of the present invention presented a fluorescent lamp operating apparatus as shown in FIG. 9 in Japanese Patent Application No. 11-161874.

The fluorescent lamp operating apparatus shown in FIG. 9 comprises an AC power supply 1, a noise-proof capacitor 2, a rectifier circuit 3, a smoothing capacitor 4, FETs 5, 6, a first resonance capacitor 7, a fluorescent lamp 8, a preheat capacitor 9, a choke coil 10, a trigger capacitor 14, Zener diodes 15, 16, a second resonance capacitor 17 and a resistance 19. In the structure shown in FIG. 9, the resonance capacitor 7, the fluorescent lamp 8, the choke coil 10 and the source and drain terminals of the P-type FET 6 as the first switching element are connected in series in that order.

The smoothing capacitor 4 is connected between one end of the resonance capacitor 7 and the drain terminal of the FET 6 so as to form a closed circuit. The N-type FET 5, which is the second switching element, is connected between the junction of the choke coil 10 and the FET 6 and the junction of the resonance capacitor 7 and the smoothing capacitor 4. The input terminals of the rectifier circuit 3 are connected to the AC power supply 1 via the noise-proof capacitor 2. The preheat capacitor 9 is connected between a pair of electrodes 8A and 8B of the fluorescent lamp 8 on the side opposite to the power supply 1. All these components together form a high-frequency inverter circuit.

The high-frequency inverter circuit first obtains a direct current by rectifying and smoothing commercial AC power supplied from the AC power supply 1. In this circuit structure, the AC power supply 1, the noise-proof capacitor 2, the rectifier circuit 3 and the smoothing capacitor 4 together compose a DC power supply 22. Then, the obtained direct current is entered into a serial circuit of the switching elements (N-type FET 5 and P-type FET 6) which are connected in parallel between the smoothing capacitor 4 and the fluorescent lamp 8 and oscillate at radio frequencies. After this, the current is entered into an LC resonance circuit composed of the choke coil 10 and the resonance capacitor 7 which is connected to the N-type FET 5 and further to the fluorescent lamp 8 in series. Thus, the inverter circuit shown in FIG. 9 generates high-frequency electric power.

As means for starting the high-frequency inverter circuit, the N-type FET 5 and the P-type FET 6 each have a closed loop between the gate and source terminals. The closed loop is composed of a second choke coil 11, the secondary winding 10A of the choke coil 10 and the trigger capacitor 14 connected in series, and one side of the trigger capacitor 14 is connected to the source terminals of the FETs 5, 6. Furthermore, resistances 12, 13 and 19, the Zener diodes 15, 16, the second choke coil 11, the secondary winding 10A of the choke coil 10 and the second resonance capacitor 17 together compose a gate driving circuit 23. The junction of the resistance 12, the second choke coil 11 and the Zener diode 15 is the output terminal of the gate driving circuit 23.

In the fluorescent lamp operating apparatus structured as described above, before the fluorescent lamp 8 is initiated, the AC power supply 1 supplies the noise-proof capacitor 2 with utility AC power to generate a pulsing voltage via the rectifier circuit 3. The current resulting from the pulsing voltage makes the smoothing capacitor 4 be charged until it reaches the power-supply voltage. In addition, the resonance capacitor 7 and the preheat capacitor 9 are charged via the resistance 19, and at the same time, the trigger capacitor 14 is charged via the resistance 12, the second choke coil 11 and the secondary winding 10A of the choke coil 10.

When the charging voltage of the trigger capacitor 14 reaches the threshold voltage in the Zener diode 15, the electric charge of the trigger capacitor 14 is supplied to the gate terminal of the FET 5 so as to turn the FET 5 on. When the FET 5 is thus placed in the ON state, the electric charges of the resonance capacitor 7 and the preheat capacitor 9 flow into the primary winding 10B of the choke coil 10 via the FET 5.

Then, the current flowing through the primary winding 10B of the choke coil 10 develops an inductive voltage in the secondary winding 10A of the choke coil 10. This causes the second choke coil 11 and the capacitor 17 to resonate, thereby making the capacitor 17 have a voltage opposite in direction to the trigger capacitor 14. Then, a reverse-biased voltage is supplied between the gate and the source of the FET 5 so as to turn the FET 5 off. At the same time, a forward-biased voltage is supplied between the gate and the source of the FET 6 to turn the FET 6 on.

When the FET 6 is thus placed in the ON state, the current flows from the smoothing capacitor 4 through the closed circuit composed of the resonance capacitor 7, the fluorescent lamp 8, the choke coil 10 and the FET 6 so as to resonate the primary winding 10B of the choke coil 10, the resonance capacitor 7 and the preheat capacitor 9. At this moment, the current flowing in the reverse direction through the primary winding 10B of the choke coil 10 develops an inverse inductive voltage at the secondary winding 10A of the choke coil 10, which resonates the second choke coil 11 and the capacitor 17, thereby making the capacitor 17 have a voltage in the opposite direction. As a result, a reverse-biased voltage is supplied between the gate and the source of the FET 6 to turn the FET 6 off. Later, a forward-biased voltage is supplied between the gate and the source of the FET 5 to turn the FET 5 back on. Hereafter, the above-described operations are repeated to turn on and off the FET 5 and the FET 6 alternately.

The above-mentioned current heats the electrodes 8A, 8B while flowing through the preheat electrode of the fluorescent lamp 8. At the same time, a large voltage is placed by resonance between the electrodes of the fluorescent lamp 8, which increases the temperature of the electrodes so as to start a discharge from the state where the impedance between the electrodes of the fluorescent lamp 8 is infinity. Once the discharge is started, the impedance between the electrodes of the fluorescent lamp 8 drops suddenly, so that an abrupt large current flows from the power line through the fluorescent lamp 8 (this phenomenon is hereinafter referred to as a breakdown, and the large current is referred to as a breakdown current). When a breakdown occurs, the impedance decreases enough to be in a normal stable lighting condition.

The inventors of the present invention have found through experiments that in a fluorescent lamp operating apparatus like this, there are cases where a sudden drop in the lamp impedance at a breakdown causes an extremely large and abrupt breakdown current to flow through the power switching elements, and this inrush current breaks the power switching elements. Furthermore, in the electrodes 8A and 8B of the fluorescent lamp 8, an abrupt and large breakdown current at start-up causes electrons to be concentrated to form a heat spot, thereby to increase local heating. This becomes an issue because it may lead to a disconnection of the electrodes to seriously damage the flashing life characteristics of the fluorescent lamp.

The present invention has been contrived in view of these aspects, with a main object of providing a fluorescent lamp operating apparatus having a fluorescent lamp whose flashing life characteristics have been improved in a simple circuit structure.

SUMMARY OF THE INVENTION

A fluorescent lamp operating apparatus of the present invention comprises: a power switching element electrically connected to a fluorescent lamp having a pair of electrodes; and means for limiting a current flowing through said power switching element by controlling conductance of said power switching element so as to prevent said power switching element from being broken by a large current flowing from a power line through said fluorescent lamp when an impedance between said pair of electrodes decreases from infinity at start-up of said fluorescent lamp.

Another fluorescent lamp operating apparatus of the present invention comprises: a top-side transistor and a down-side transistor connected in series between output terminals of a direct current power supply; a serial circuit composed of a capacitor, a fluorescent lamp having a pair of electrodes, a preheat capacitor connected in parallel with said fluorescent lamp, and an inductor, said serial circuit being connected between an output terminal of said direct current power supply and a junction of said top-side transistor and said bottom-side transistor; a gate driving circuit for turning on and off said top-side transistor and said bottom-side transistor alternately in accordance with a current flowing through said fluorescent lamp; and resistances connected between respective gate terminals of said top-side transistor and said bottom-side transistor and said gate driving circuit.

In an embodiment, said direct current power supply comprises an alternating current power supply, a rectifier circuit connected to said alternating current power supply, a smoothing capacitor connected between output terminals of said rectifier circuit, and said top-side transistor and said bottom-side transistor are connected in series between the output terminals of said rectifier circuit.

In an embodiment, said top-side transistor and said bottom-side transistor are an N-type transistor and a P-type transistor, respectively.

DESCRIPTION OF THE PREFERRED EMBODIMENT

The embodiment of the present invention will be described as follows with reference to the drawings. It must be noted that the present invention is not restricted to the following embodiment.

Figure 1:
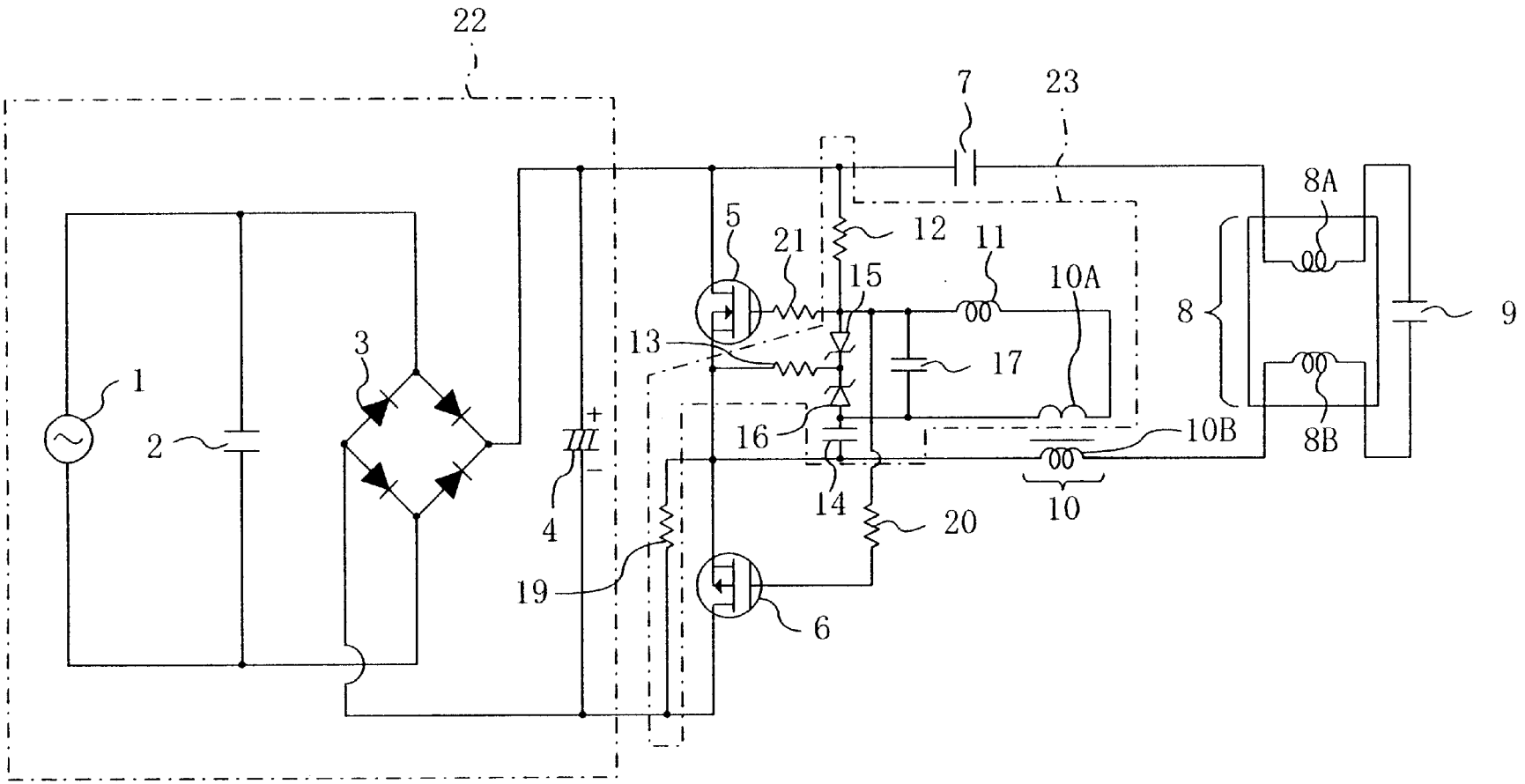
FIG. 1 shows the circuit diagram of the fluorescent lamp operating apparatus of the embodiment of the present invention.

FIG. 1 shows the circuit structure of the fluorescent lamp operating apparatus of the embodiment of the present invention.

The fluorescent lamp operating apparatus of the present embodiment comprises power switching elements (FET 5 and FET 6) electrically connected to a fluorescent lamp 8 having a pair of electrodes 8A and 8B, and means (20 and 21) for limiting the current flowing through the power switching elements (5, 6) by controlling the conductance of these elements, in order to prevent the power switching elements (5, 6) from being broken by a large current flowing from the power line through the fluorescent lamp 8 when the impedance between the pair electrodes (8A, 8B) decreases from infinity at the start-up of the fluorescent lamp 8. In the fluorescent lamp operating apparatus of the present embodiment, the means (20, 21) for limiting the current flowing through the power switching elements can prevent the power switching elements from being broken by an abrupt and large breakdown current rushing into the elements at the start-up. These means also prevent the occurrence of a disconnection of the electrodes. As a result, the flashing life characteristics of the fluorescent lamp are improved.

As shown in FIG. 1, the fluorescent lamp operating apparatus of the present embodiment is composed of an AC power supply 1, a noise-proof capacitor 2, a rectifier circuit 3, a smoothing capacitor 4, FETs 5, 6, a first resonance capacitor 7, a fluorescent lamp 8, a preheat capacitor 9, a choke coil 10, a trigger capacitor 14, Zener diodes 15, 16, a second resonance capacitor 17 and a resistance 19.

To be more specific, the fluorescent lamp operating apparatus shown in FIG. 1 comprises a top-side transistor 5 and a bottom-side transistor 6 connected in series between the output terminals of a DC power supply 22. Between an output terminal of the DC power supply 22 and the junction of the top-side and bottom-side transistors 5 and 6, there is a serial circuit composed of the capacitor (resonance capacitor) 7, the fluorescent lamp 8 having the pair electrodes (8A, 8B), the preheat capacitor 9 connected in parallel with the fluorescent lamp 8 and the inductor (choke coil) 10.

This serial circuit is connected to the gate driving circuit 23 provided with a feature of turning on and off the top-side and bottom-side transistors 5 and 6 alternately in accordance with the current flowing through the fluorescent lamp 8. In the present embodiment, the gate driving circuit 23 is composed of a second choke coil 11, a secondary winding 10A of the choke coil 10 and the trigger capacitor 14 connected in series, and one side of the trigger capacitor 14 is connected to the source terminals of the FETs 5 and 6. The gate driving circuit 23 further comprises the resistances 12, 13 and 19, the Zener diodes 15, 16 and the second resonance capacitor 17. The junction of the resistance 12, the second choke coil 11 and the Zener diode 15 is the output terminal of the gate driving circuit 23.

The resistances 21 and 20 are connected between the gate driving circuit 23 and the gate terminals of the top-side and bottom-side transistors 5 and 6, respectively. The resistance 20 (or 21) has a feature of controlling the conductance of the bottom-side transistor 6 (or the top-side transistor 5). The top-side transistor 5 and the bottom-side transistor 6 in the present embodiment are an N-type transistor (N-type FET) and a P-type transistor (P-type FET), respectively. In other words, these transistors are structured to be complementary from the view point of achieving power savings. In the present specification, the "top-side" in the top-side transistor 5 and the "bottom-side" in the bottom-side transistor 6 are used for convenience of explanation, and could be replaced by the "first" and the "second", respectively. Although these transistors are structured to be complementary in the present embodiment, it is possible that the top-side transistor 5 (first transistor) and the bottom-side transistor 6 (second transistor) are structured either as N-type transistors (N-type FETs) or P-type transistors (P-type FETs). In either structure, the resistance 21 (or 20) can control the conductance of the top-side transistor 5 (or the bottom-side transistor 6).

The DC power supply 22 of the present embodiment includes the AC power supply 1, the rectifier circuit 3 connected to the AC power supply 1, and the smoothing capacitor 4 connected between the output terminals of the rectifier circuit 3. The N-type FET 5 and the P-type FET 6 are connected in series between the output terminals of the rectifier circuit 3.

Figure 9:
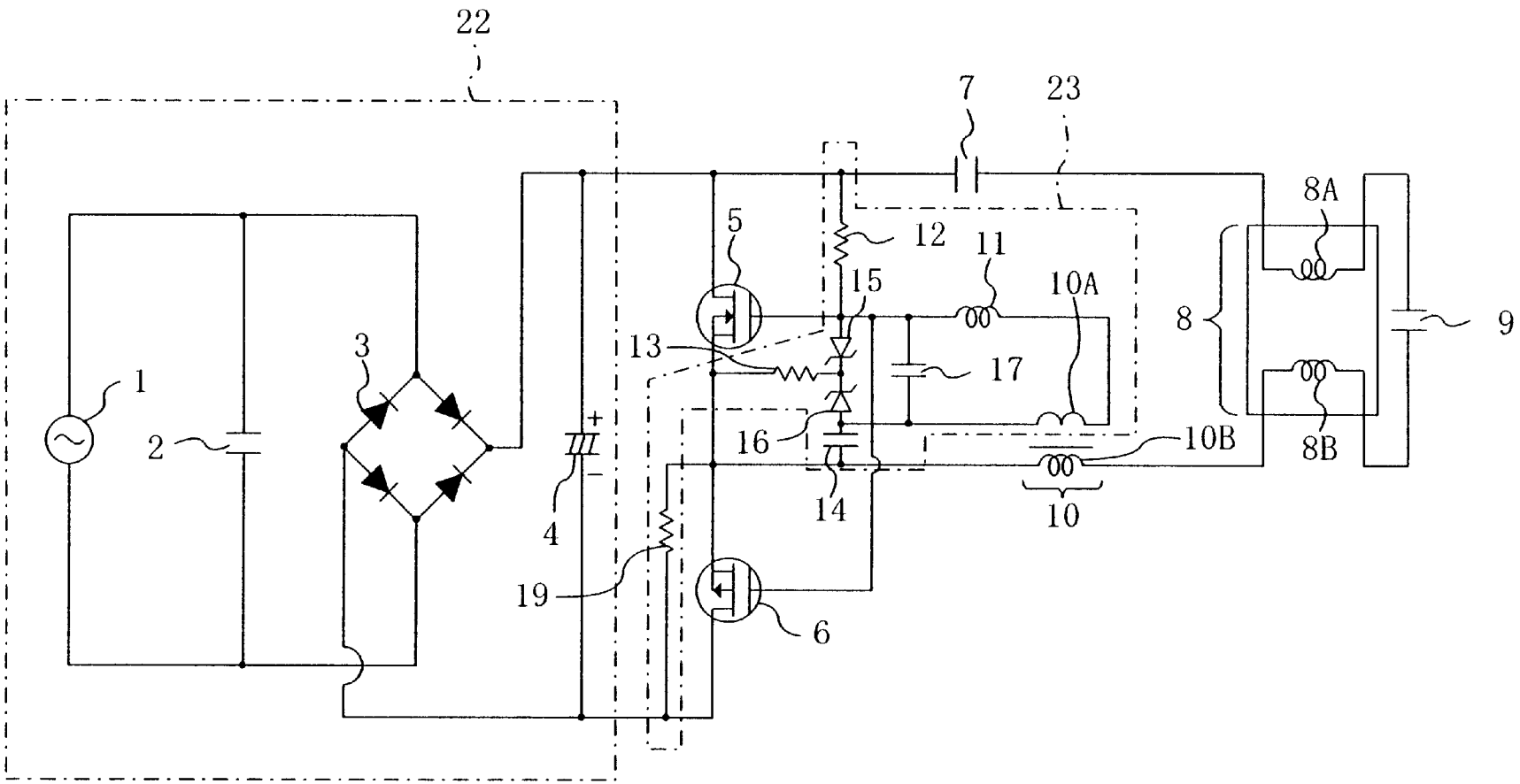
FIG. 9 shows the circuit diagram of a fluorescent lamp operating apparatus.

The behavior of the fluorescent lamp operating apparatus of the present embodiment will be described as follows. The structure of the present embodiment is similar to the structure shown in FIG. 9 in that a sudden drop in the impedance between the electrodes 8A, 8B of the fluorescent lamp 8 causes a breakdown current to flow when the lamp is lit; however, is different in that inserting the resistances 21 and 20 between the gate driving circuit 23 and the gate terminals of the FETs 5 and 6, respectively, which are the power switching elements, prevents the FETs 5 and 6 from being broken by the breakdown current.

The following is the reason the insertion of the resistances 21, 20 can prevent the FETs 5 and 6 from being broken by the breakdown current.

Figure 2A:
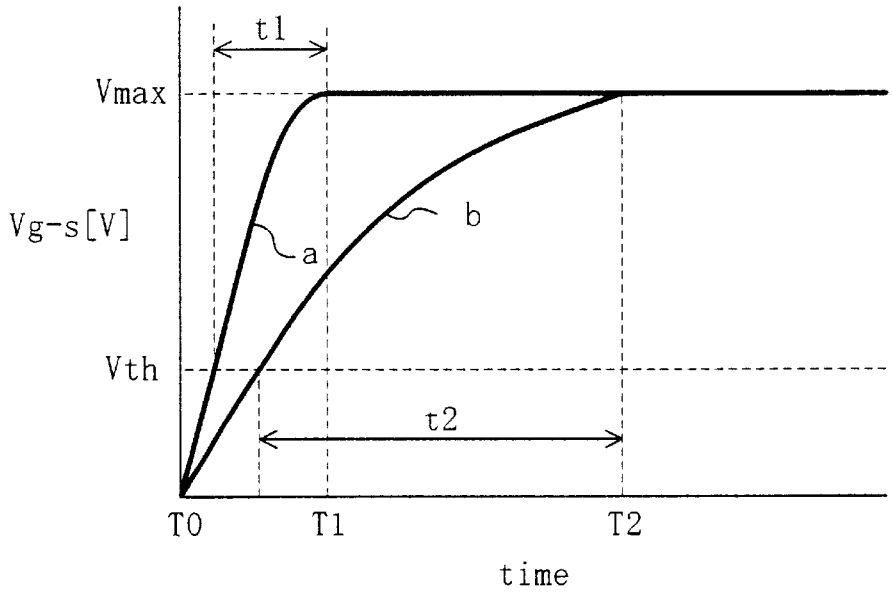
FIG. 2A is a graph showing changes in input voltage at the gate terminal of the FET 6 due to the resistance 20.

FIG. 2A shows the difference in changes in input voltage at the gate terminal of the FET 6 between the presence and absence of the resistance 20. The horizontal axis and the vertical axis (Vg−s) represent time and the gate voltage, respectively. Line "a" and line "b" show changes in voltage at the gate terminal in the absence and presence of the resistance 20, respectively.

Figure 2B:
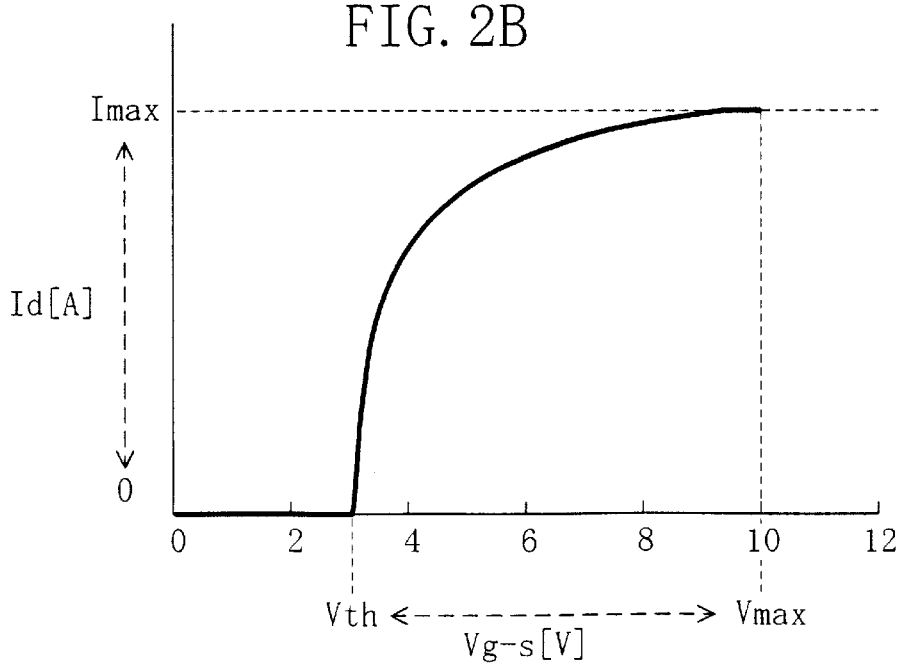
FIG. 2B is a graph showing the relationship between the gate voltage and the drain current in the FET.

As apparent from lines "a" and "b" in FIG. 2A, the insertion of the resistance 20 extends the time required for the output voltage of the gate driving circuit to reach the maximum voltage Vmax from T1 to T2. The duration between the threshold voltage Vth of the gate terminal at which the FET 6 is actually turned on and the maximum voltage Vmax of the output voltage of the gate driving circuit is extended from t1 to t2. As shown in FIG. 2B, the drain current Id changes in accordance with the gate voltage Vg−s. Thus, the relation between the gate voltage Vg−s (horizontal axis) and the drain current Id (vertical axis) indicates that decreasing the difference between t1 and t2 in FIG. 2A, or the switching speed of the PET 6 can limit the abrupt large breakdown current flowing through the FET 6 at the start-up of the FET 6, thereby preventing the di/dt breakage of the FET 6. In other words, the fluorescent lamp operating apparatus of the present embodiment can control the conductance of the FET 6 by means of the resistance 20, which limits the current flowing through the FET 6, thereby protecting the FET 6 from the abrupt large breakdown current.

Figure 3:
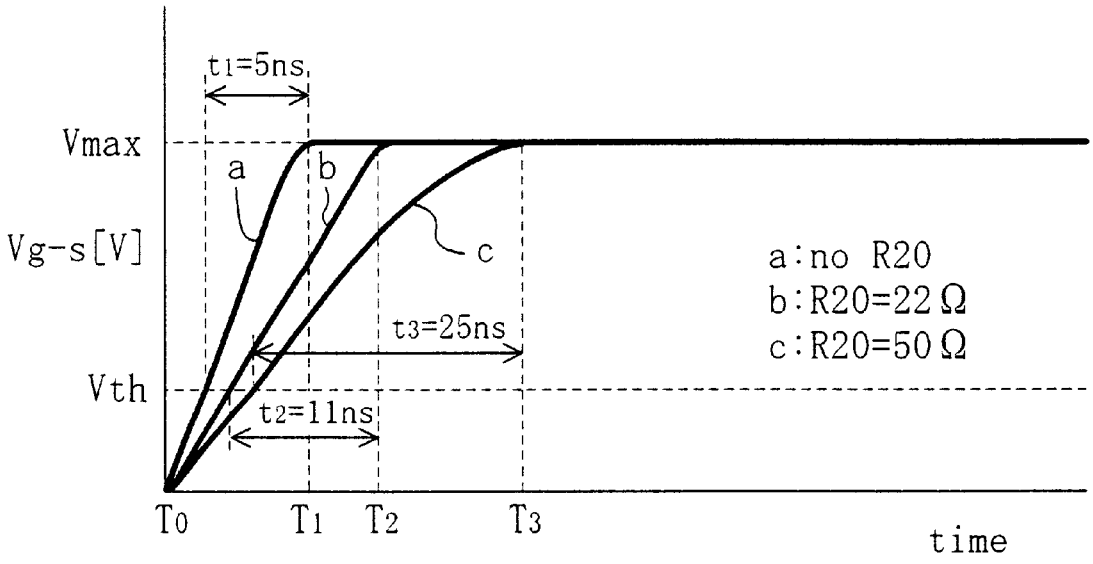
FIG. 3 is a graph showing changes in input voltage at the gate terminal of the FET 6 when the resistance 20 is absent (line a), 22Ω (line b), and 50Ω (line c).

FIG. 3 shows changes in input voltage at the gate terminal of the FET 6 when the resistance 20 is absent (line a), 22Ω (line b) and 50Ω (line c). When the resistance 20 is absent (line a), t1 has a duration of 5 ns (5 nanoseconds). In contrast, when the resistance 20 is 22Ω (line b) and 50Ω (line b), t2 has a duration of 11 ns, and t3 a duration of 25 ns. The other conditions than the resistance 20 in the present embodiment will be shown as follows:

| | |
|---|---|
| choke coil 10 | 101.5T (primary side)/5T (secondary side) 0.61 mH |
| choke coil 11 | 470 μH |
| resonance capacitor 17 | 1800 pF |
| smoothing capacitor 4 | 47 μF |
| N-type FET 5 | IRFR234A |
| P-type FET 6 | SFR9234 |
| resonance capacitor 7 | 0.1 μF |
| fluorescent iamp 8 | G modei 25W type (standard) |
| preheat capacitor 9 | 5600 pF |
| resistance 12 | 2 MΩ |
| resistance 13 | 100 kΩ |
| resistance 19 | 270 kΩ |
| trigger capacitor 14 | 560 pF |
| Zener diodes 15, 16 | $V_{ZD}$ = 10 V |

Figure 4A:
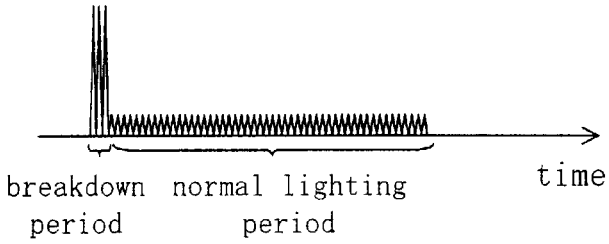
FIG. 4A is a graph showing the breakdown period and the normal lighting period.
Figure 4B:
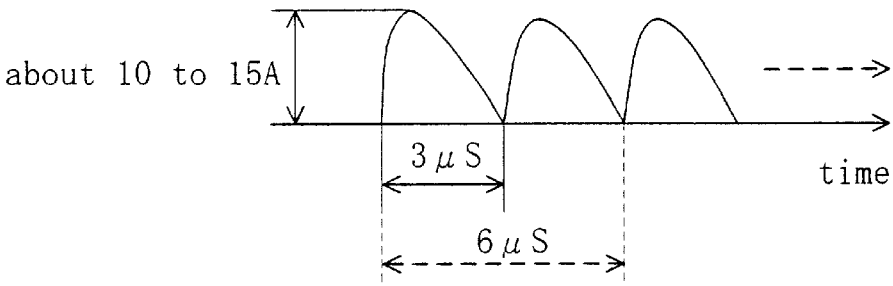
FIG. 4B is a graph showing the current waveform in the breakdown period.
Figure 4C:
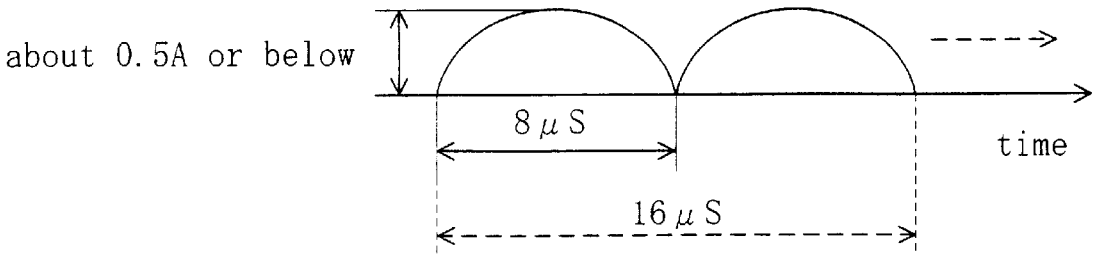
FIG. 4C is a graph showing the current waveform in the normal lighting period.

In general, as shown in FIG. 4A, when the fluorescent lamp is lit, a breakdown period (about 0.05 milliseconds (50 microseconds)) comes first, which is followed by a normal lighting period. In the breakdown period, a resonance of about 160 kHz occurs, during which a current of about 10 to 15 A changes in a cycle of several microseconds (one cycle: 6 μS, half cycle: 3 μS) as shown in FIG. 4B. On the other hand, in the normal lighting period, a resonance of about 60 kHz occurs, and a current of about 0.5 A or below flows in a cycle of 16 μS as shown in FIG. 4C. Thus, in the breakdown period, the flow of an abrupt large current (breakdown current) takes place.

Figure 5:
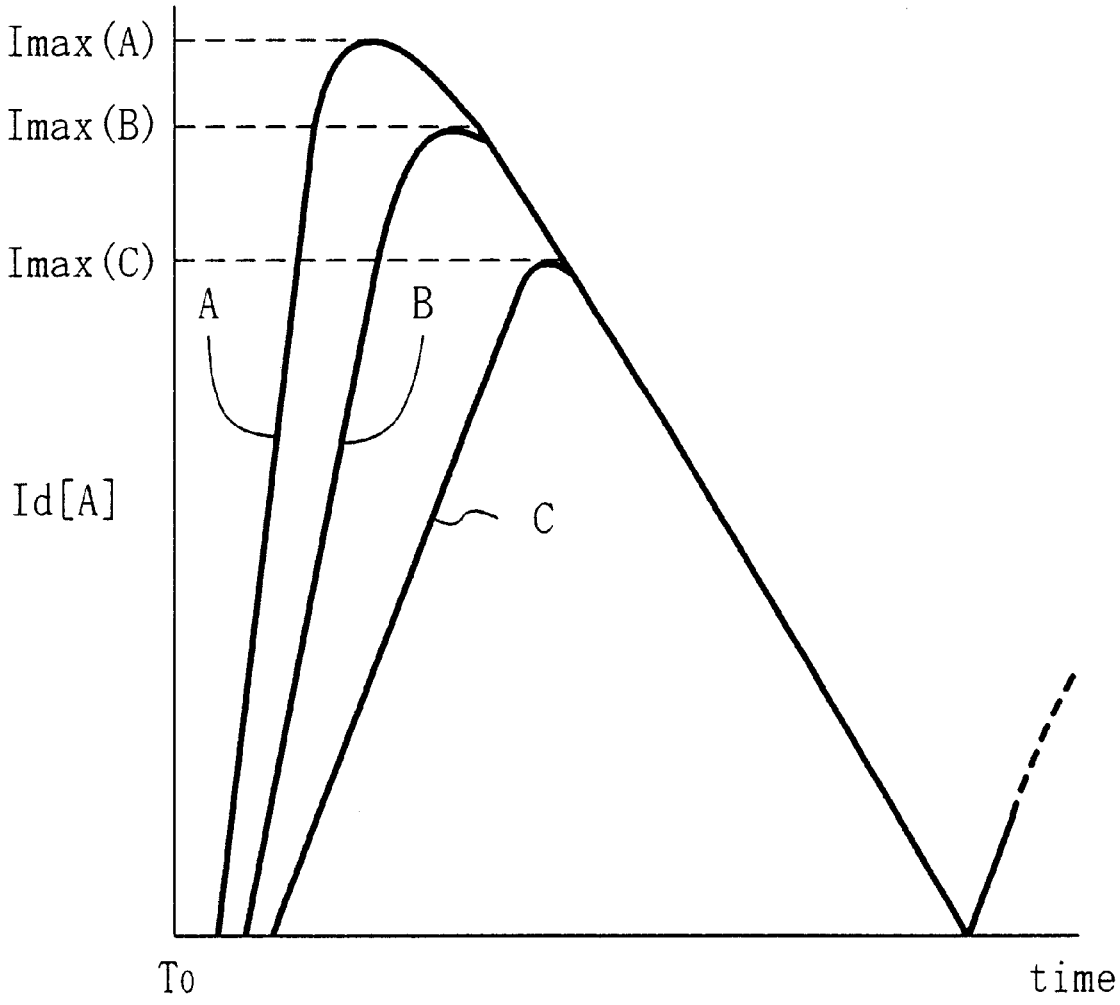
FIG. 5 is a graph showing changes in the drain current (Id) of the FET 6 when the resistance 20 is absent (line A), 22Ω (line B), and 50Ω (line C).

In the structure of the present embodiment, as apparent from FIGS. 2A and 3, the FET 6 is turned on later in the presence of the resistance 20 than in the case where the resistance 20 is absent. This causes a delay on the rising edge of the half-wave waveform shown in FIG. 4B (the rising edge of the breakdown current). As a result, as shown in FIG. 5, the Id (drain current) with its peak at Imax (A) in the absence of the resistance 20 (line A) has its peak at Imax (B) and at Imax (C) when the resistance 20 is 22Ω (line B) and 50Ω (line C), respectively. This indicates that the insertion of the resistance 20 can lower the peak of the Id, and also reduce the total amount of the inrush current as apparent from a comparison of line A and line B. In FIG. 5, line A to line C (Imax (a) to Imax (c)) are exaggerated for easy interpretation.

Thus, the insertion of the resistance 20 can limit the current flowing through the FET 6, thereby protecting the FET 6 from the abrupt large breakdown current. The successful limitation of the abrupt large breakdown current at the start-up can lessen the occurrence of the heat spot due to the concentration of electrons at the electrodes 8A, 8B of the fluorescent lamp, thereby reducing the local heating. This prevents a disconnection of the electrodes so as to achieve long lasting qualities.

Figure 6:
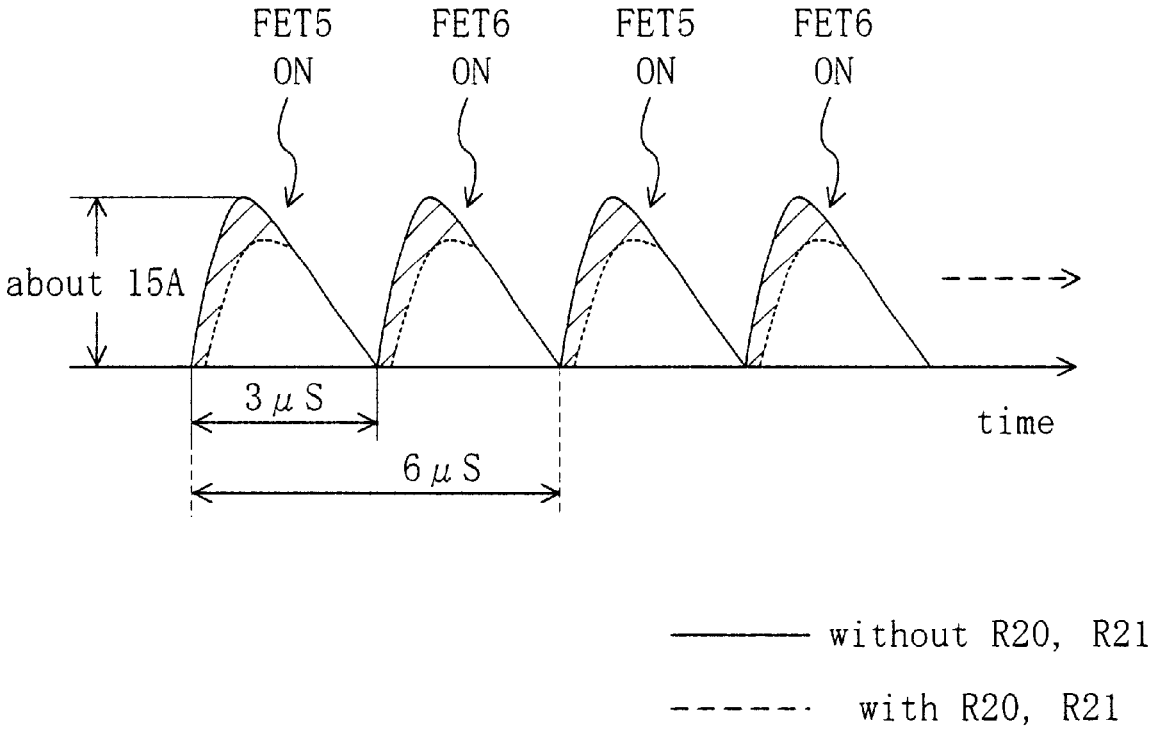
FIG. 6 is a graph showing the waveforms of the drain currents of the FETs 6 and 5 in the breakdown period.

In the above description, the bottom-side transistor (P-type FET 6) is taken as an example; similarly, the FET 5 could be protected from the breakdown current by inserting the resistance 21 between the gate terminal of the top-side transistor (N-type FET 5) and the output terminal of the gate driving circuit. As shown in FIG. 6, the insertion of both the resistances 21 and 20 can lower the current peak values in the half-wave waveforms both when the FET 5 is turned on and when the FET 6 is turned on, reducing the current corresponding to the diagonally shaded area in FIG. 6. This can mitigate the stress of both the FETs 5 and 6. It must be noted that the N-type FET 5 causes the first one-pulse operation with a large peak current, so that the insertion of only the resistance 21 out of the two resistances 20, 21 has the effect of improving the flashing life characteristics. This has been verified by the inventors of the present invention through experiments. The use of the resistance 21 alone can realize reduction of costs compared with the case where both the resistances 20 and 21 are used.

The resistances (gate resistance: $R_G$) 20, 21 are not restricted to those with 22Ω and 50Ω; appropriate ones could be chosen in accordance with the circuit used. In the structure of the present embodiment, the resistances 20, 21 are preferably not less than 22Ω nor more than 220Ω.

Figure 7A:
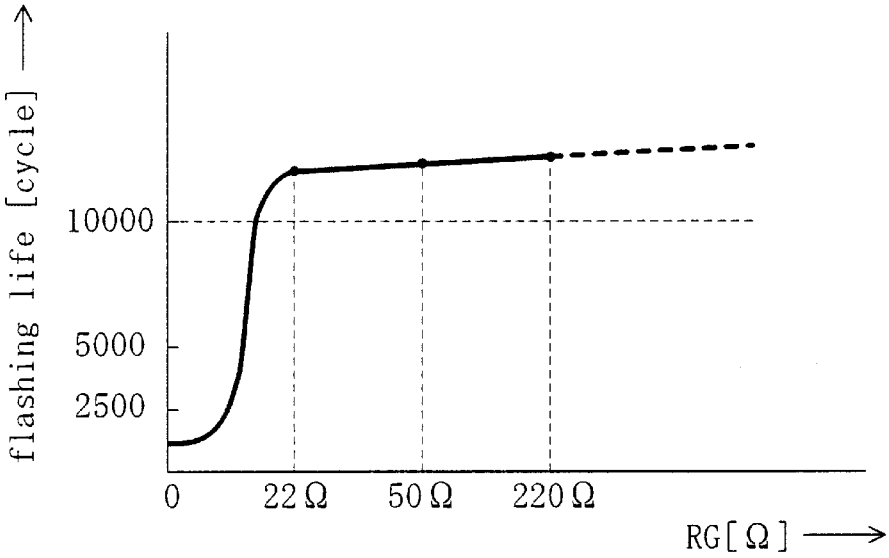
FIG. 7A is a schematic graph showing the relation between the resistance value (Ω) of the resistance ($R_G$) and the flashing life (cycle)

Being not less than 22Ω is preferable because otherwise the power switching elements (FETs 5, 6) might not fully protected from the breakdown current. As shown in FIG. 7A, when the resistance is less than 220Ω, there might be cases where the flashing life is barely able to reach 2000 cycles or so which is far below 10000 cycles in a flashing life test (one cycle consists of ON for 30 seconds and OFF for 30 seconds). In contrast, when the resistance is 22Ω or more, the flashing life can reach 12000 cycles or more, which is more than 3 times as large as in the case where the resistance 20, 21 is absent.

Figure 7B:
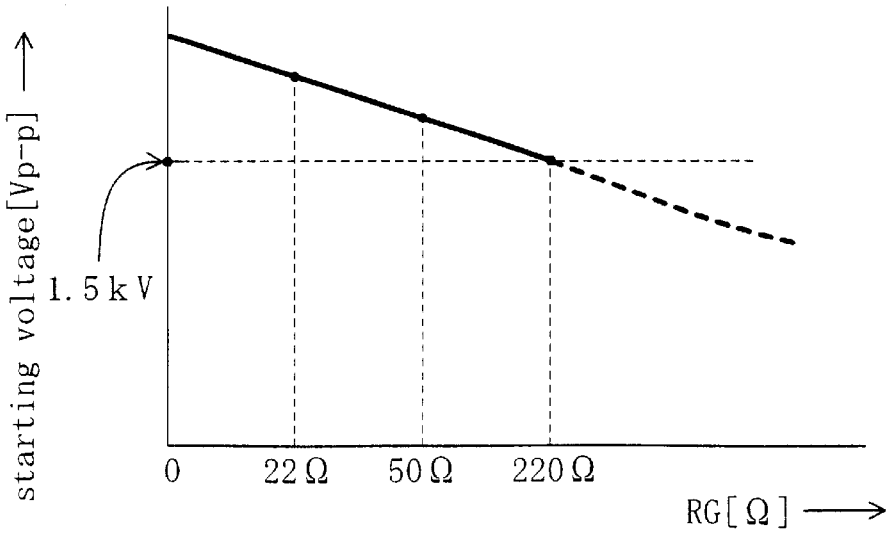
FIG. 7B is a graph showing the relation between the resistance value (Ω) of the resistance ($R_G$) and the start-up voltage.

Being not more than 220Ω is preferable because otherwise, as shown in FIG. 7B, there might be cases where it fails to obtain a minimum starting voltage (about 1.5 kV for example) necessary for the breakdown of the fluorescent lamp 8. In other words, the larger the resistance is, the less effect the breakdown current has, so that the stress of the power switching elements (FETs 5, 6) can be mitigated; however, it is preferable that the resistance is 220Ω or below (22Ω, 47Ω, 100Ω for example) in order to secure the minimum starting voltage.

Since the P-type FET 6 and the N-type FET 5 have different characteristics from each other, the resistances 20 and 21 may have different resistance values from each other in accordance with the respective characteristics, or may have the same resistance value (22Ω for example). The inventors of the present invention have verified through experiments that using the resistances 20, 21 having the same resistance value has the effect of improving the flashing life. The use of the resistances with the same resistance value can also facilitate the procurement of the resistance elements.

According to the results of the flashing life test (the fluorescent lamp used: G model 25 W type) conducted by the inventors of the present invention, when the resistances 20, 21 were not used, the numbers of the life cycles were 4625, 1851, 3492, and 3139 (conducted 4 times). On the other hand, when the resistances 20, 21 with a resistance value of 22Ω were used, the numbers of the life cycles were 13225, 13555, 12586, and 12540 (conducted 4 times) which attained a flashing life of over 12000 cycles.

Similarly, when the resistances 20, 21 with a resistance value of 47Ω were used, the numbers of the life cycles were 17106, 18103, 12500, and 12775 (conducted 4 times), which also attained a flashing life of over 12000 cycles. When the resistances 20, 21 with a resistance value of 100Ω were used, the numbers of the life cycles were 14335, 15663, 12400, and 12775 (conducted 4 times), which also attained a flashing life of over 12000 cycles.

Figure 8:
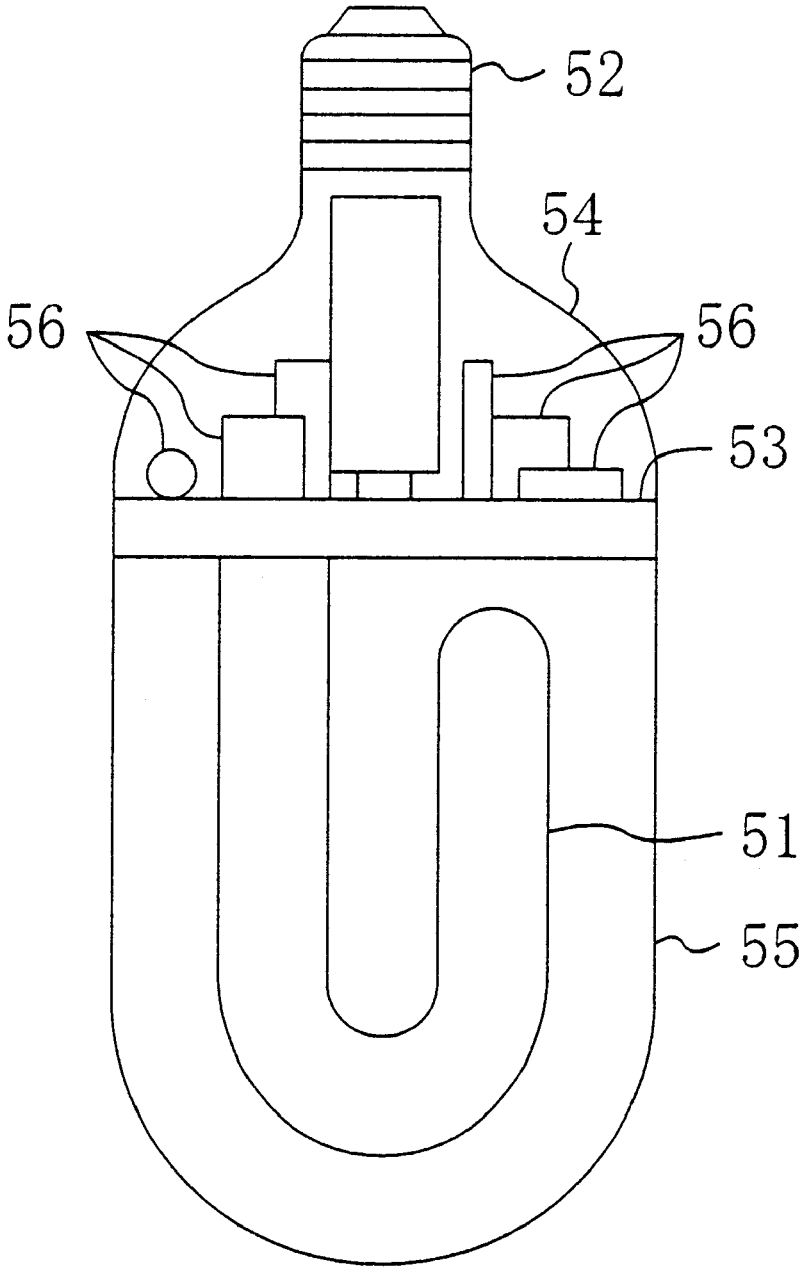
FIG. 8 shows a schematic view of the structure of the compact self-ballasted fluorescent lamp of the embodiment of the present invention.

The fluorescent lamp operating apparatus of the present embodiment can be structured as a compact self-ballasted fluorescent lamp as shown in FIG. 8. FIG. 8 shows the schematic structure of the compact self-ballasted fluorescent lamp of the present embodiment.

The compact self-ballasted fluorescent lamp shown in FIG. 8 comprises a fluorescent lamp 51 formed by bending the fluorescent lamp 8 shown in FIG. 1, a base 52 such as an E26 type for an incandescent lamp, a circuit board 53 containing the wiring of the ballast circuit shown in FIG. 1 and circuit components 56, a cover 54 which houses the circuit board 53 and has the base 52 attached at an end, and a globe 55 which is translucent and covers the fluorescent lamp 51. Although it is not illustrated, the fluorescent lamp 51 and the circuit board 53 are electrically connected, and the circuit board 53 and the base 52 are also electrically connected. The lamp is screwed in a socket for an incandescent lamp via the base 52 to supply power, thereby operating the fluorescent lamp. The circuit board 53 contains the circuit components 56 to compose the switching circuit; however, FIG. 8 shows the main components only.

In the present embodiment, the resistances 20, 21 are used as means for limiting the current flowing through the power switching elements (FETs 6, 5) by controlling their conductance. Since the resistance elements (resistances 20, 21) are relatively small in size, they can be easily mounted on the circuit board 53 for a compact self-ballasted fluorescent lamp with a relatively small packaging area. The structure with the resistance elements is advantageous because it is relatively simple and can be realized at a low cost. In the structure not using the resistances 20, 21 shown in FIG. 9, the breakage of the power switching elements due to the breakdown current can be mitigated by using power switching elements highly resistant to pressure and a large current. However, such power switching elements have a drawback of being too large in size to be contained on the circuit board 53 of the compact self-ballasted fluorescent lamp with a small packaging area. As another drawback, these power switching elements are so expensive as to raise the cost.

According to the present invention, the power switching elements can be prevented from being broken by a breakdown current by the means for controlling the conductance of the power switching elements, thereby limiting the current flowing through the power switching elements. Furthermore, the heat spot due to the concentrated electrons at the electrodes of the fluorescent lamp occurs less frequently, and the local heating can be decreased, which prevents the occurrence of a disconnection in the electrodes. This achieves the effect of improving the flashing life characteristics of the fluorescent lamp. In addition, inserting resistances between the gate terminals of the top-side and bottom-side transistors and the gate driving circuit can realize a small-sized inexpensive fluorescent lamp operating apparatus having improved flashing life characteristics in a simple circuit structure. Furthermore, power savings can be realized by making the top-side and bottom-side transistors an N-type transistor and a P-type transistor, respectively.

What is claimed is:

1. A fluorescent lamp operating apparatus comprising:

a power switching element electrically connected to a fluorescent lamp having a pair of electrodes; and a resistance limiting a current flowing through said power switching element by controlling conductance of said power switching element so as to prevent said power switching element from being broken by a large current flowing from a power line through said fluorescent lamp when an impedance between said pair of electrodes decreases from infinity at start-up of said fluorescent lamp.

2. A fluorescent lamp operating apparatus comprising:

a top-side transistor and a down-side transistor connected in series between output terminals of a direct current power supply;

a serial circuit composed of a capacitor, a fluorescent lamp having a pair of electrodes, a preheat capacitor connected in parallel with said fluorescent lamp, and an inductor, said serial circuit being connected between an output terminal of said direct current power supply and a junction of said top-side transistor and said bottom-side transistor;

a gate driving circuit for turning on and off said top-side transistor and said bottom-side transistor alternately in accordance with a current flowing through said fluorescent lamp; and resistances connected between respective gate terminals of said top-side transistor and said bottom-side transistor and said gate driving circuit.

3. The fluorescent lamp operating apparatus of claim 2, wherein said direct current power supply comprises an alternating current power supply, a rectifier circuit connected to said alternating current power supply, a smoothing capacitor connected between output terminals of said rectifier circuit, and said top-side transistor and said bottom-side transistor are connected in series between the output terminals of said rectifier circuit.

4. The fluorescent lamp operating apparatus of claim 2, wherein said top-side transistor and said bottom-side transistor are an N-type transistor and a P-type transistor, respectively.

5. The fluorescent lamp operating apparatus of claim 3, wherein said top-side transistor and said bottom-side transistor are an N-type transistor and a P-type transistor, respectively.

* * * * *

UNITED STATES PATENT AND TRADEMARK OFFICE

CERTIFICATE OF CORRECTION

PATENT NO. : 6,429,602 B1
DATED : August 6, 2002
INVENTOR(S) : Kenichiro Takahashi et al.

It is certified that error appears in the above-identified patent and that said Letters Patent is hereby corrected as shown below:

Title page,
Item [56], References Cited, U.S. PATENT DOCUMENTS, "4,935,822" should be -- 4,935,862 --.

Signed and Sealed this

Fourth Day of March, 2003

JAMES E. ROGAN
*Director of the United States Patent and Trademark Office*